US009399344B2

(12) United States Patent
Tanjo

(10) Patent No.: US 9,399,344 B2
(45) Date of Patent: Jul. 26, 2016

(54) LIQUID EJECTING APPARATUS

(71) Applicant: SEIKO EPSON CORPORATION, Tokyo (JP)

(72) Inventor: Toru Tanjo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/845,570

(22) Filed: Sep. 4, 2015

(65) Prior Publication Data

US 2016/0001559 A1 Jan. 7, 2016

(51) Int. Cl.
*B41J 2/165* (2006.01)
*B41J 25/308* (2006.01)

(52) U.S. Cl.
CPC ..... *B41J 2/16511* (2013.01); *B41J 2/16585* (2013.01); *B41J 25/308* (2013.01); *B41J 25/3088* (2013.01); *B41J 2002/16514* (2013.01)

(58) Field of Classification Search
CPC ..... B41J 11/20; B41J 2/165; B41J 23/00; B41J 2002/16514; B41J 2/16511; B41J 2/16585; B41J 25/308; B41J 25/3088
See application file for complete search history.

(56) References Cited

U.S. PATENT DOCUMENTS 8,662,633 B2 3/2014 Tanaka et al.
2001/0021330 A1* 9/2001 Kishida ..... B41J 23/025 400/55
2005/0219308 A1 10/2005 Nakashima

FOREIGN PATENT DOCUMENTS

JP 2010-023523 A 2/2010
JP 2013-049201 A 3/2013

* cited by examiner

*Primary Examiner* — Sarah Al Hashimi
(74) *Attorney, Agent, or Firm* — Workman Nydegger

(57) ABSTRACT

A liquid ejecting apparatus includes a liquid ejecting unit that ejects an ink from a nozzle to a sheet transported, an adjustment mechanism that adjusts the height position of the liquid ejecting unit by moving the liquid ejecting unit, a cap capable of tightly closing a space that the nozzle faces, and a moving mechanism that moves the cap between a tightly closing position and a non-tightly closing position. The adjustment mechanism includes a pivot shaft provided along a width direction, a plurality of cams that moves the liquid ejecting unit by pivoting together with the pivot shaft and contacting the liquid ejecting unit, and an engaging portion capable of pivoting together with the pivot shaft and engaging with an engaged portion that is provided on the liquid ejecting apparatus.

6 Claims, 6 Drawing Sheets

LIQUID EJECTING APPARATUS

BACKGROUND

1. Technical Field

The present invention relates to a liquid ejecting apparatus, for example, an ink jet type printer and the like.

2. Related Art

An example of a related-art liquid ejecting apparatus is an ink jet type printer that performs printing by ejecting ink (liquid) from a plurality of nozzles formed in a nozzle formation surface of a liquid ejecting unit to a medium such as a sheet that is transported. Such a printer includes a cap for maintaining the characteristic of ink ejection from the nozzles (for example, JP-A-2010-23523).

Specifically, the cap contacts the liquid ejecting unit and covers a space that the nozzles face, so as to restrain the ink from evaporating from the nozzles and recover ink discharged from the nozzles.

When the foregoing cap contacts the liquid ejecting unit, the urging force that the urging member applies to the cap also acts on the liquid ejecting unit. Therefore, in a construction where the liquid ejecting unit is movably provided in order to adjust the size of a gap between the transported medium and the liquid ejecting unit, the liquid ejecting unit shifts in position when pressed by the cap. Then, the cap cannot contact the liquid ejecting unit with a sufficient pressure, leading to a risk of failing to maintain appropriate characteristics of ejection of ink from the nozzles.

This problem is not limited to the printers equipped with a cap as described above but is substantially universal among liquid ejecting apparatuses equipped with such a cap.

SUMMARY

An advantage of some aspects of the invention is that a liquid ejecting apparatus in which the cap can be caused to contact, with a sufficient pressure, a liquid ejecting unit that is provided so as to be adjustable in position is provided.

A liquid ejecting apparatus according to an aspect of the invention includes a liquid ejecting unit that ejects a liquid from a nozzle to a medium transported by a transport section, an adjustment mechanism that adjusts a height position of the liquid ejecting unit by moving the liquid ejecting unit, a cap capable of tightly closing a space that the nozzle faces, and a moving mechanism that moves the cap between a tightly closing position at which the cap tightly closes the space that the nozzle faces and a non-tightly closing position that is different from the tightly closing position. The adjustment mechanism includes a pivot shaft provided along a width direction that intersects a transport direction in which the medium is transported by the transport section, a plurality of cams that are spaced from each other in the width direction and move the liquid ejecting unit by pivoting together with the pivot shaft and contacting the liquid ejecting unit, and an engaging portion capable of pivoting together with the pivot shaft and engaging with an engaged portion that is provided on the liquid ejecting apparatus. The engaging portion engages with the engaged portion from a direction different from a movement direction in which the cap moves from the non-tightly closing position to the tightly closing position.

According to this construction, the engaging portion that pivots together with the pivot shaft engages with the engaged portion provided on the liquid ejecting unit from a direction different from the movement direction of the cap. Therefore, when the cap is brought into contact with the liquid ejecting unit, the movement of the liquid ejecting unit pressed by the cap in contact can be restricted by engagement of the engaging portion and the engaged portion. Hence, the cap can be caused to contact, with a sufficient pressure, the liquid ejecting unit provided to be adjustable in position.

In the foregoing liquid ejecting apparatus, the engaging portion may engage with the engaged portion from the direction opposite to the movement direction.

According to this construction, the engaging portion engages with the engaged portion of the liquid ejecting unit from the direction opposite to the direction in which the cap presses the liquid ejecting unit. Therefore, the movement of the liquid ejecting unit pressed by the cap in contact can be efficiently restricted.

In the foregoing liquid ejecting apparatus, the engaged portion and the pivot shaft may be substantially aligned in the movement direction.

According to this construction, when the engaging portion pivoting together with the pivot shaft is engaged with the engaged portion, the engaging portion and the pivot shaft are substantially aligned along the movement direction of the cap. Therefore, even in the case where the cap moves in the movement direction and contacts the liquid ejecting unit to press the liquid ejecting unit, the risk that the engaging portion pressed by the engaged portion of the liquid ejecting unit may pivot can be reduced.

In the foregoing liquid ejecting apparatus, the adjustment mechanism may adjust the height position of the liquid ejecting unit between a first position and a second position that is higher than the first position, and the engaging portion may engage with the engaged portion of the liquid ejecting unit when the liquid ejecting unit is at a position different from the second position.

According to this construction, the liquid ejecting unit is adjusted in position between the first position and the second position. The engaging portion engages with the engaged portion of the liquid ejecting unit when the liquid ejecting unit is at the position different from the second position. Therefore, the moving distance of the cap can be shortened in comparison with the case where the cap is caused to contact the liquid ejecting unit while the engaging portion is engaged with the engaged portion of the liquid ejecting unit when the liquid ejecting unit is at the second position higher than the first position.

In the foregoing liquid ejecting apparatus, the engaged portion may be protruded from the liquid ejecting unit.

According to this construction, since the engaged portion is protruded from the liquid ejecting unit, the degree of freedom in disposing the liquid ejecting unit and the pivot shaft can be increased.

In the liquid ejecting apparatus, the engaged portion of the liquid ejecting unit at the position different from the second position and the engaging portion are spaced from each other by a gap when the cap comes into contact with the liquid ejecting unit, and the cap may come into contact with the liquid ejecting unit and then press the liquid ejecting unit in such a direction as to eliminate the gap.

DESCRIPTION OF EXEMPLARY EMBODIMENTS

As an embodiment of the liquid ejecting apparatus of the invention, an ink jet type printer which includes a liquid ejecting unit that ejects an ink, an example of a liquid, and which ejects the ink to a sheet, an example of a medium, so as to print (record) an image that includes characters, graphics, etc. will be described hereinafter with reference to the drawings.

Figure 1:
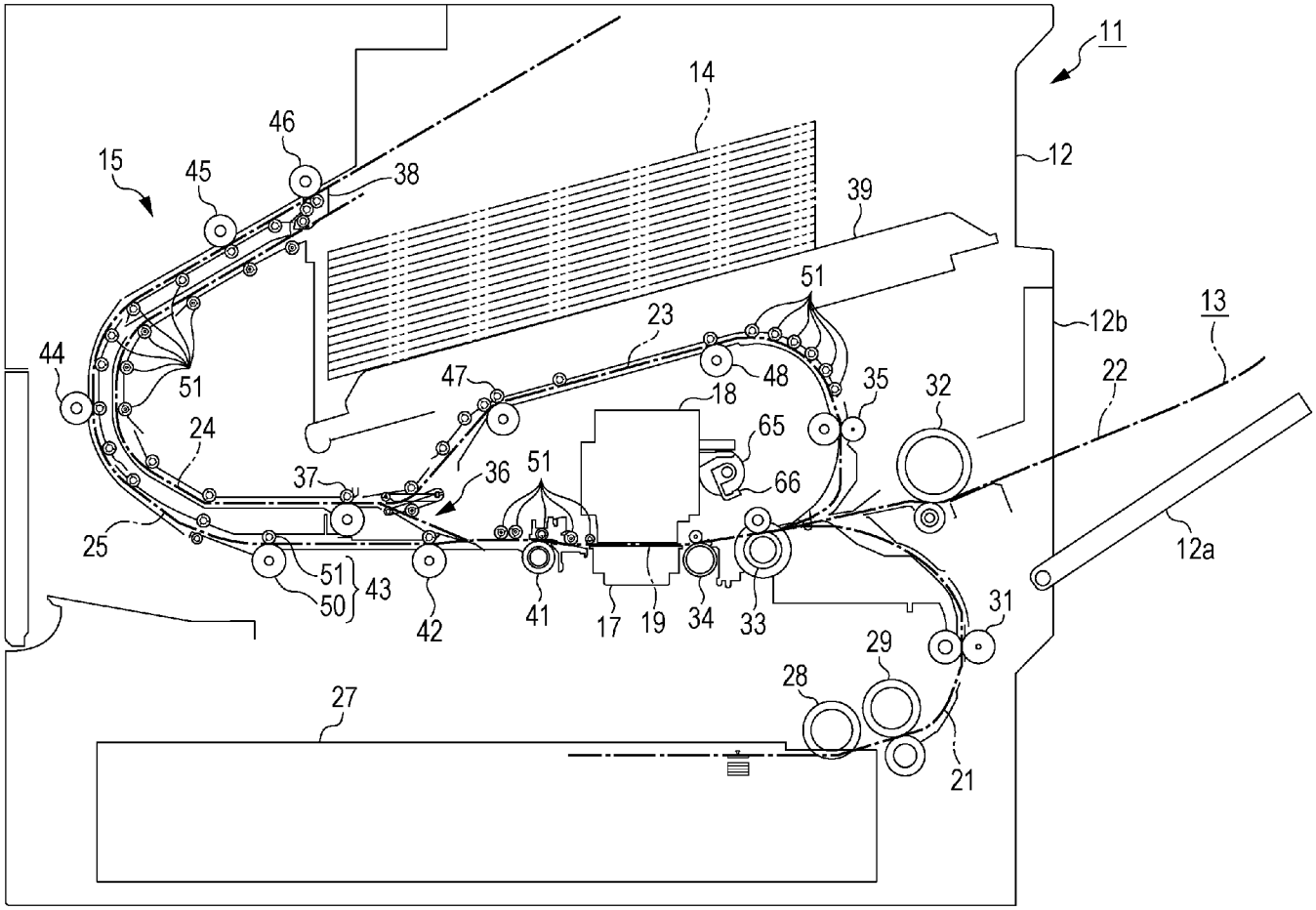
FIG. 1 is a structure diagram schematically showing a printer according to an embodiment of the invention.

As shown in FIG. 1, a printer 11 as an example of the liquid ejecting apparatus of this embodiment includes a casing 12 having a generally rectangular parallelepiped shape and a transport section 15 that transports a sheet 14 along a transport path 13 indicated by one-dot chain lines in FIG. 1. Furthermore, along the transport path 13 there are fixed a support table 17 that supports a sheet 14 from a gravity direction side and a liquid ejecting unit 18 that faces the support table 17 across the transport path 13.

The liquid ejecting unit 18 is a generally termed line head capable of ejecting the ink simultaneously over a region extending in a width direction that intersects a sheet transport direction. The liquid ejecting unit 18 performs printing by ejecting the ink to a sheet 14 that passes by while being supported by the support table 17. Incidentally, in the following description, a position on the transport path 13 between the support table 17 and the liquid ejecting unit 18 will be referred to as print position 19.

Then, the transport path 13 is made up of a first feed path 21 and a second feed path 22 that are at an upstream side of the print position 19 in the transport direction, and a third feed path 23, a branch path 24, and a discharge path 25 that are at a downstream side of the print position 19 in the transport direction.

The first feed path 21 is a path that connects the print position 19 and a sheet cassette 27 that is provided in a bottom portion of a casing 12, that is, a gravity direction-side portion thereof, so that the sheet cassette 27 can be inserted into and pulled out from the bottom portion. The first feed path 21 is provided with a pickup roller 28 that sends out the uppermost sheet 14 of the sheets 14 mounted in a stacked state in the sheet cassette 27, and a separator roller 29 that separates one sheet at a time from the sheets 14 sent out by the pickup roller 28. Furthermore, a first feed roller pair 31 is provided at the downstream side of the separator roller 29 in the transport direction.

The second feed path 22 connects the print position 19 and an insertion opening 12*b* that is provided in a side surface of the casing 12 and that is exposed when a cover 12*a* provided on the side surface is opened. The second feed path 22 is provided with a second feed roller pair 32 that clamps and transports the sheet 14 inserted via the insertion opening 12*b*. Furthermore, at a meeting point of the first feed path 21, the second feed path 22, and the third feed path 23, a third feed roller pair 33 and a fourth feed roller pair 34 are provided, and the third feed path 23 is provided with a fifth feed roller pair 35.

The third feed path 23 is provided so as to surround the liquid ejecting unit 18 and is a path for returning the sheet 14 that has once passed through the print position 19 back to the upstream side of the print position 19. More specifically, a branching mechanism 36 is provided at the downstream side of the print position 19, and a branching roller pair 37 capable of both forward rotation and reverse rotation is provide on the branch path 24 branching from the discharge path 25.

The discharge path 25 connects the print position 19 and a discharge opening 38 through which the printed sheet 14 is discharged. Incidentally, the sheet 14 discharged from the discharge opening 38 is let to lie on a discharge tray 39. The discharge path 25 is provided with at least one transport roller pair (six pairs in this embodiment, that is, first to sixth transport roller pairs 41 to 46). Furthermore, the third feed path 23 is also provided with a seventh transport roller pair 47 and an eighth transport roller pair 48. The first to eighth transport roller pairs 41 to 48 clamp and transport a sheet 14 on which the ink has deposited.

That is, the first to eighth transport roller pairs 41 to 48 are each made up of a cylindrical driving roller 50 that rotates based on the drive force of a drive source, and a toothed roller 51 that is passively rotated as the driving roller 50 rotates. Furthermore, a toothed roller 51 can be provided singly without being paired with the driving roller 50. Specifically, toothed rollers 51 are provided on the third feed path 23, the branch path 24, and the discharge path 25, at a side that faces a printed surface of each sheet 14 on which printing has been performed (i.e., the surface where the ink, an example of a liquid, has been ejected and has deposited). Furthermore, the toothed rollers 51 are also provided between adjacent ones of the first to eighth transport roller pairs 41 to 48, and also between the transport roller pairs and the liquid ejecting unit 18. On the other hand, the driving roller 50 is provided at a side that a not-printed surface of the sheet 14 not subjected to printing or a surface of a two-side printed sheet 14 on which printing was performed the earlier faces when passing by.

In this embodiment, the transport section 15 is composed of the pickup roller 28, the separator roller 29, the first to fifth feed roller pairs 31 to 35, the branching mechanism 36, the branching roller pair 37, and the first to eighth transport roller pairs 41 to 48.

Figure 2:
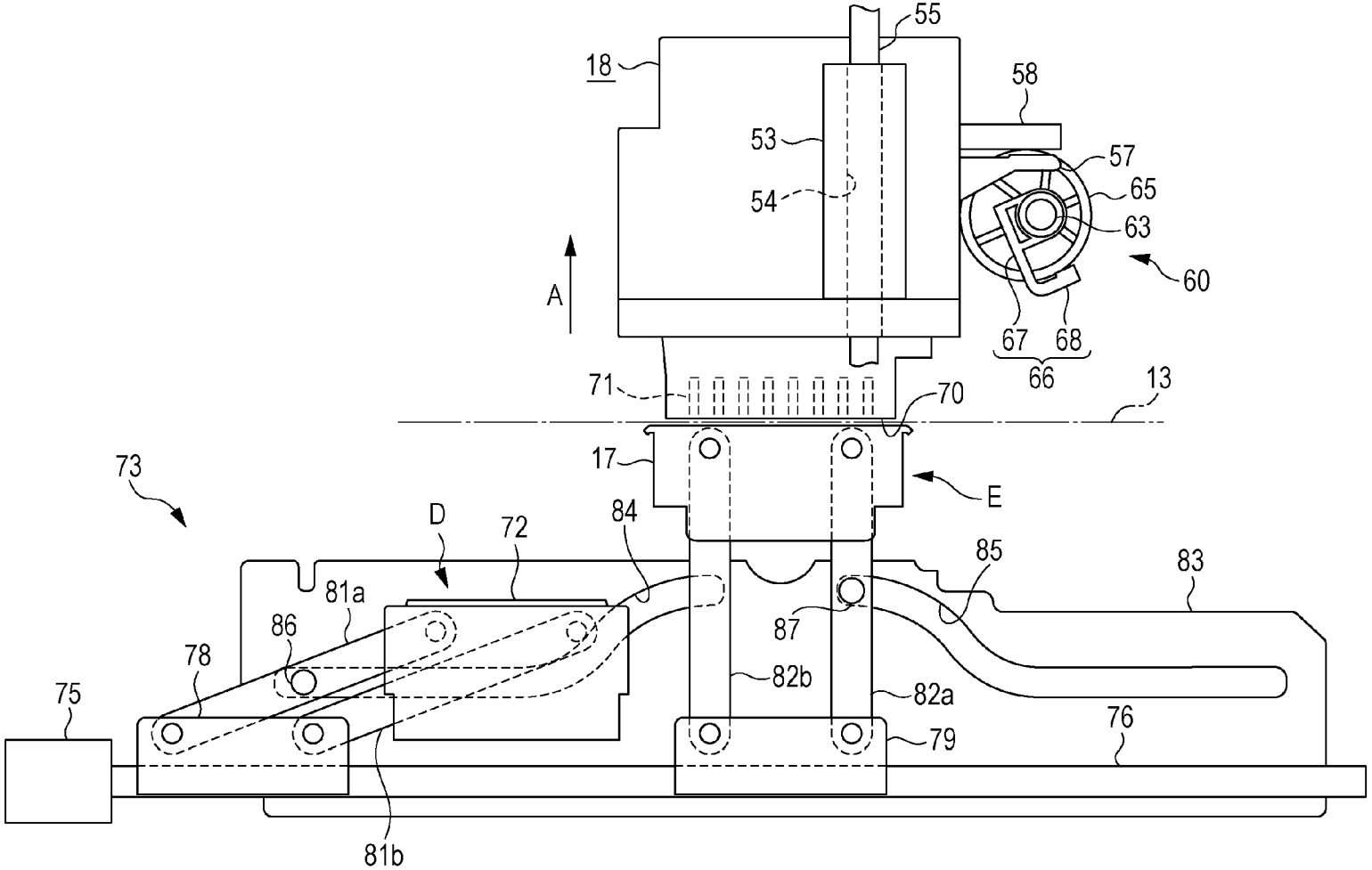
FIG. 2 is a schematic diagram of a liquid ejecting unit and a moving mechanism.

As shown in FIG. 2, two side portions of the liquid ejecting unit 18 in the width direction (a near side portion and a far side portion in the drawing of FIG. 2) are provided with tube portions 53. Each tube portion 53 is provided with a guide hole 54 that extends therethrough. Furthermore, a frame (not depicted in the drawings) is provided with rod-shaped guide members 55 that extend along a direction that intersects the transport direction and the width direction. The liquid ejecting unit 18 is attached, with the guide members 55 inserted into the guide holes 54. Incidentally, the diameter of the guide holes 54 is larger than the diameter of the guide members 55. The liquid ejecting unit 18 is movable while being guided by the guide members 55. In this embodiment, the direction in which the guide member 55 extends and in which the liquid ejecting unit 18 is moved along the guide members 55 away from the transport path 13 is termed the movement direction A.

Figure 3:
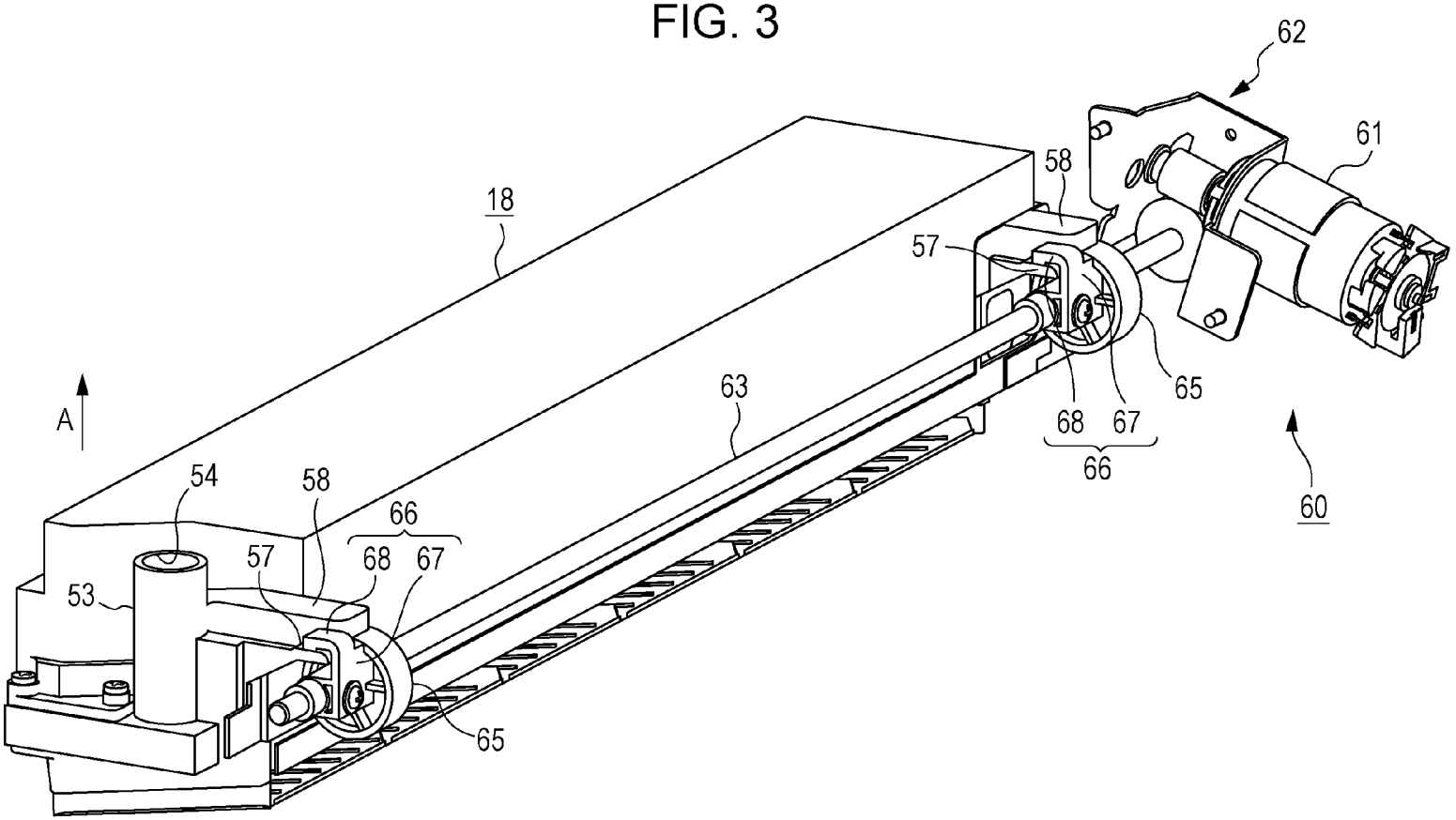
FIG. 3 is a perspective view of the liquid ejecting unit and an adjustment mechanism.

As shown in FIG. 2 and FIG. 3, on the liquid ejecting unit 18 there are at least one engaged portion 57 and a plurality of follower portions 58 that are protruded from an upstream-side side surface of the liquid ejecting unit 18 in the transport direction. In this embodiment, one engaged portion 57 and one follower portion 58 adjacent to each other in the width direction make a pair, and two pairs of an engaged portion 57 and a follower portion 58 are provided, with a space left therebetween in the width direction.

Furthermore, in this embodiment, the engaged portion 57 and the follower portion 58 of each pair are offset from each other in the width direction and the movement direction A. That is, the engaged portion 57 and the follower portion 58 of each pair are formed so that a lower surface of the follower portion 58 which faces the transport path 13 is farther apart from the transport path 13 than an upper surface of the engaged portion 57 which is opposite to the transport path 13 is from the transport path 13. The side of the liquid ejecting unit 18 on which the engaged portions 57 and the follower portions 58 are formed are provided with an adjustment mechanism 60 that adjusts the size of a gap between the liquid ejecting unit 18 and the transport path 13 by moving the liquid ejecting unit 18 to adjust the height position thereof.

As shown in FIG. 3, the adjustment mechanism 60 includes an adjustment motor 61 capable of both forward rotation and reverse rotation, a transfer mechanism 62 for transferring drive force of the adjustment motor 61, and a pivot shaft 63 that pivots in both directions of forward rotation and reverse rotation due to the drive force transferred to the transfer mechanism 62. Incidentally, the pivot shaft 63 is provided so as to extend along the width direction. Then, the pivot shaft 63 is provided with a plurality of (two in this embodiment) cams 65 that are spaced apart from each other in the width direction so as to correspond to the follower portions 58.

As shown in FIG. 2 and FIG. 3, each cam 65 is an eccentric cam which has a generally disk shape and through which the pivot shaft 63 extends at a position different from the center of the cam. The cams 65 pivot together with the pivot shaft 63 and remain in contact with the respective follower portions 58 of the liquid ejecting unit 18, so that the liquid ejecting unit 18 is pushed upward and is allowed to descend following the cams 65. In this manner, the position of the liquid ejecting unit 18 is adjusted.

Furthermore, the pivot shaft 63 is provided with at least one engaging portion 66 that pivots together with the pivot shaft 63 and that is capable of engaging with an engaged portion 57 of the liquid ejecting unit 18. The at least one engaging portion 66 is provided so as to correspond to such an engaged portion 57. Specifically, in this embodiment, two engaging portions 66 are provided with a space therebetween in the width direction.

Each engaging portion 66 is composed of a proximal end portion 67 supported by the pivot shaft 63 and a hook portion 68 having a shape in which the hook portion 68 is bent relative to the proximal end portion 67. As for the thickness of the engaging portion 66, the thickness of a distal end of the hook portion 68 is greater than the thickness of other portions. Furthermore, an inside diameter measured from the pivot shaft 63 as the center to an inner surface of the hook portion 68 that engages with the engaged portion 57 is equal to an outside diameter of the cam 65 measured in the same direction as that inside diameter.

Furthermore, each engaged portion 57 is provided so as to align with the pivot shaft 63 in the movement direction A. That is, each engaged portion 57 extends from the upstream-side side surface of the liquid ejecting unit 18 to reach over the pivot shaft 63, so that the pivot shaft 63 lies between each engaged portion 57 and the transport path 13. Therefore, if the adjustment motor 61 is driven in the forward rotation direction from a state shown in FIG. 2, the engaging portion 66 pivots in the forward direction (pivots counterclockwise in FIG. 2) as the pivot shaft 63 pivots. Then, as shown in FIG. 3, the pivot shaft 63, each engaged portion 57, and the hook portion 68 of each engaging portion 66 are aligned along the movement direction A. Therefore, the engaging portions 66 become able to engage with the engaged portions 57 from a direction substantially opposite to the movement direction A (from above in FIG. 2).

As shown in FIG. 2, a nozzle formation surface 70 of the liquid ejecting unit 18 which faces the transport path 13 is provided with a plurality of nozzles 71 that eject ink. The printer 11 further includes a cap 72 capable of tightly closing a space that the nozzles 71 face by contacting the liquid ejecting unit 18 from the transport path 13 side, and a moving mechanism 73 that moves the cap 72 and the support table 17 relatively to the liquid ejecting unit 18.

The moving mechanism 73 includes a movement motor 75 capable of both forward rotation and reverse rotation, a screw shaft 76 that is rotatable in both the forward and reverse directions according to rotation of the movement motor 75, and a cap-side slider 78 and a support table-side slider 79 that are screwed to the screw shaft 76. The cap-side slider 78 is connected to the cap 72 by a first outer link member 81*a* and a first inner link member 81*b* that make a pair. Furthermore, the support table-side slider 79 is connected to the support table 17 by a second outer link member 82*a* and a second inner link member 82*b* that make a pair.

A cap-side guide rail 84 and a support table-side guide rail 85 that are gently curved in shape have been formed on a wall member 83. Incidentally, the cap-side guide rail 84 and the support table-side guide rail 85 have been formed so as to be symmetrical about a reference line (not depicted) that extends in the movement direction A through a reference point defined at a position at which the liquid ejecting unit 18 is provided. Specifically, the cap-side guide rail 84 and the support table-side guide rail 85 have been formed so that center-side end portions of the cap-side guide rail 84 and the support table-side guide rail 85, that is, the reference line-side end portions thereof, are located at an upper side closer to the liquid ejecting unit 18 in the movement direction A and outer-side end portions thereof are located at a lower side remote from the liquid ejecting unit 18 in the movement direction A.

A cap-side guide portion 86 provided on the first outer link member 81*a* connected to the cap 72 is inserted in the cap-side guide rail 84 so as to be movable along the cap-side guide rail 84. On the other hand, a support table-side guide portion 87 provided on the second outer link member 82*a* connected to the support table 17 is inserted in the support table-side guide rail 85 so as to be movable along the support table-side guide rail 85.

Figure 4:
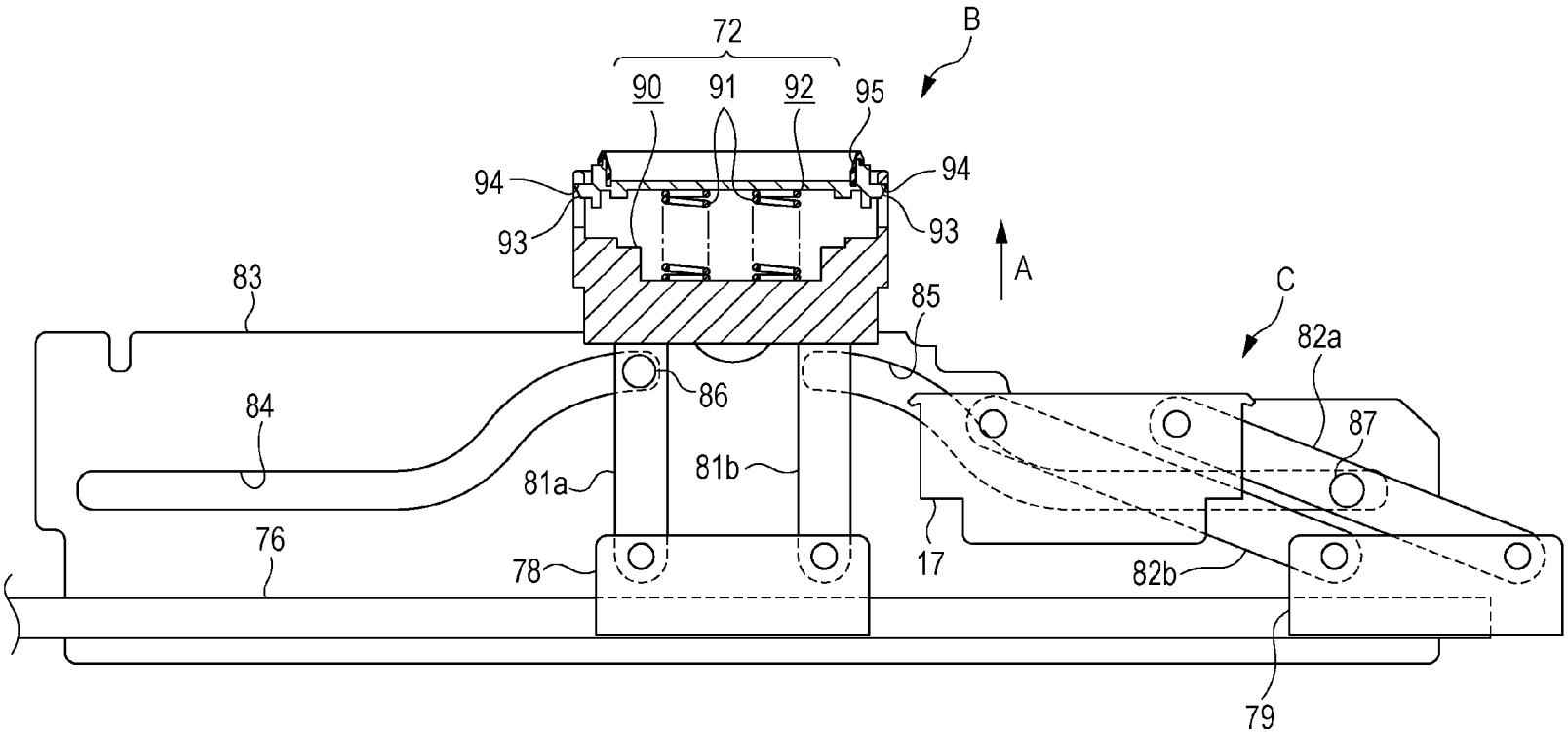
FIG. 4 is a schematic diagram showing a cap in section and the moving mechanism.

As shown in FIG. 4, the cap 72 includes a bottomed rectangular box-shaped cap holder 90 whose upper end, which is at the liquid ejecting unit 18 side, is open and a bottomed rectangular box-shaped cap-forming member 92 disposed within the cap holder 90 via at least one spring 91 (two springs 91 in this embodiment). The cap-forming member 92 has a pawl portion 93 that is protruded in a direction that intersects the movement direction A. The pawl portion 93 is hooked to a stopper portion 94 that is formed on the cap holder 90. Therefore, the cap-forming member 92 is hooked to the stopper portion 94 while being urged by the springs 91 that tend to expand and contract along the movement direction A, so that the cap-forming member 92 is positioned at a position apart from the bottom of the cap holder 90. Furthermore, an upper end edge of the cap-forming member 92 is surrounded by a rectangular cap frame 95 made of a flexible material such as rubber.

Next, the operation of the moving mechanism 73 at the time of moving the cap 72 will be described.

Incidentally, in FIG. 4, the cap 72 is positioned at a tightly closing position B at which the cap 72 contacts the liquid ejecting unit 18 (omitted from the illustration in FIG. 4) and tightly closes the space that the nozzles 71 face. At this time, the support table 17 is positioned at a non-support position C at which the support table 17 is apart from the transport path 13 of the sheet 14 and does not support the sheet 14.

If from this state, the movement motor 75 is driven in the forward rotation direction, the cap-side slider 78 and the support table-side slider 79 move along the axis direction of the screw shaft 76 so as to approach the movement motor 75 according to the rotation of the movement motor 75.

Then, as shown in FIG. 2, the cap 72 moves away from the liquid ejecting unit 18, and moves to a non-tightly closing position D that is different from the tightly closing position B. On the other hand, the support table 17 moves closer to the liquid ejecting unit 18 and finally moves to a support position E at which the support table 17 supports the sheet 14.

When the movement motor 75 is driven in the reverse rotation direction, the cap-side slider 78 and the support table-side slider 79 move away from the movement motor 75 along the axis direction of the screw shaft 76. Then, the cap 72 having been positioned at the non-tightly closing position D moves to the tightly closing position B, and the support table 17 having been positioned at the support position E moves to the non-support position C. Therefore, the moving mechanism 73 moves the cap 72 between the tightly closing position B and the non-tightly closing position D and, at the same time, moves the support table 17 between the non-support position C and the support position E.

Subsequently, the operation of the adjustment mechanism 60 at the time of adjusting the position of the liquid ejecting unit 18 will be described.

Figure 5:
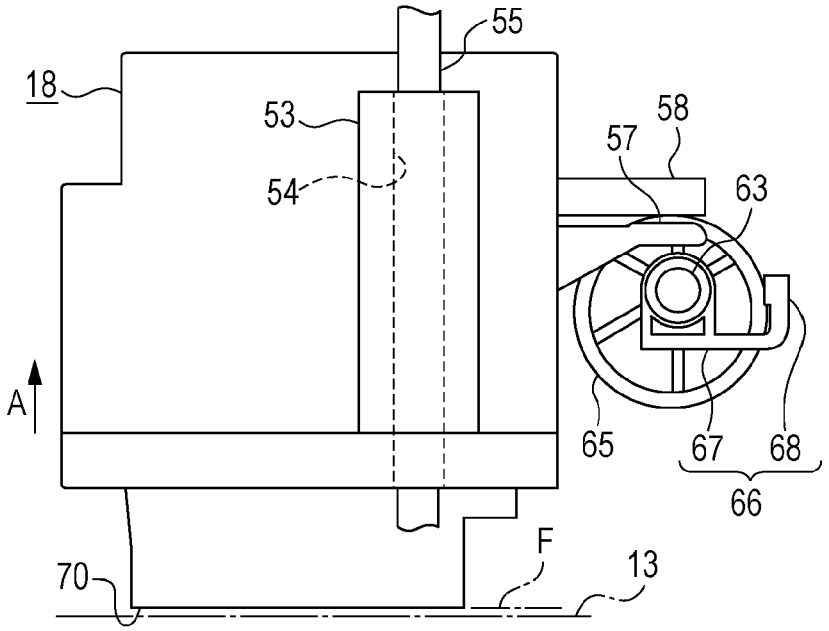
FIG. 5 is a schematic diagram showing the liquid ejecting unit positioned at a first position.

As shown in FIG. 5, the liquid ejecting unit 18 is fixed in position relative to the transport path 13 by the follower portions 58 being in contact with the cams 65. Incidentally, FIG. 5 shows the case where the liquid ejecting unit 18 is positioned at a first position F that is a low position close to the transport path 13. Then, when the adjustment motor 61 is driven in the reverse rotation direction, the pivot shaft 63 and the cams 65 pivot in the reverse direction (in the clockwise direction in FIG. 5).

Figure 6:
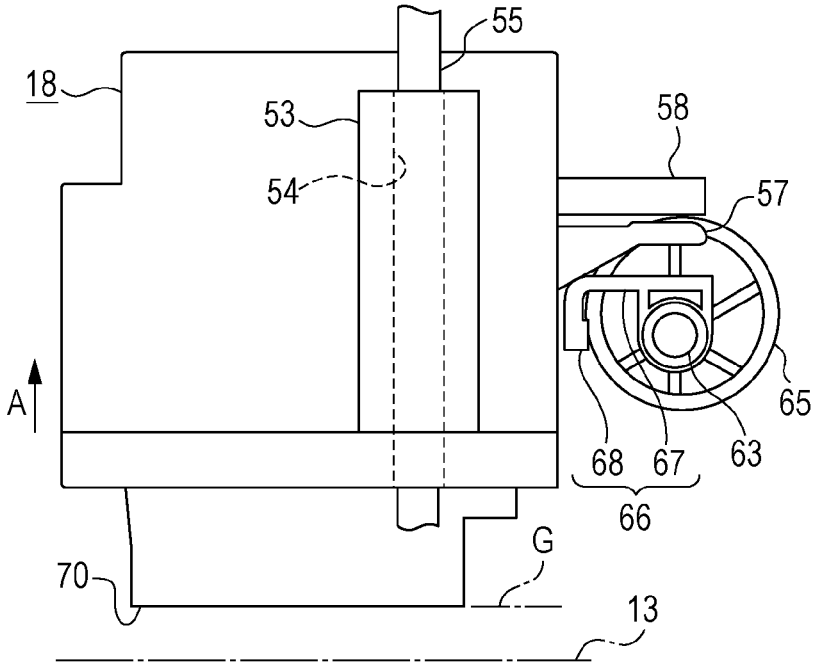
FIG. 6 is a schematic diagram showing the liquid ejecting unit positioned at a second position.

As a result, as the cams 65 pivot, the follower portions 58 in contact with the cams 65 are pushed upward as shown in FIG. 6. Then, the liquid ejecting unit 18 moves in the movement direction A from the first position F while being guided by the guide members 55, and finally moves to a second position G that is a position farther from the transport path 13 than the first position F is.

On the other hand, when the adjustment motor 61 is driven in the forward rotation direction, the cams 65 pivot in the forward direction (the counterclockwise direction in FIG. 6) together with the pivot shaft 63, so that the liquid ejecting unit 18 moves to the first position F side. That is, the adjustment mechanism 60 adjusts the position of the liquid ejecting unit 18 between the first position F and the second position G.

Next, the operation at the time of bringing the cap 72 into contact with the liquid ejecting unit 18 so that the cap 72 tightly closes the space that the nozzles 71 face will be described by focusing particularly on the operation of the adjustment mechanism 60. In this embodiment, the cap 72 contacting the liquid ejecting unit 18 to tightly close the space that the nozzles 71 face is referred to as "capping". The capping is carried out, for example, at the time of non-printing, that is, when printing on a sheet 14 is not performed, or when the printer 11 is transported. When the capping is to be carried out, first the adjustment motor 61 is driven in the forward rotation direction.

Figure 7:
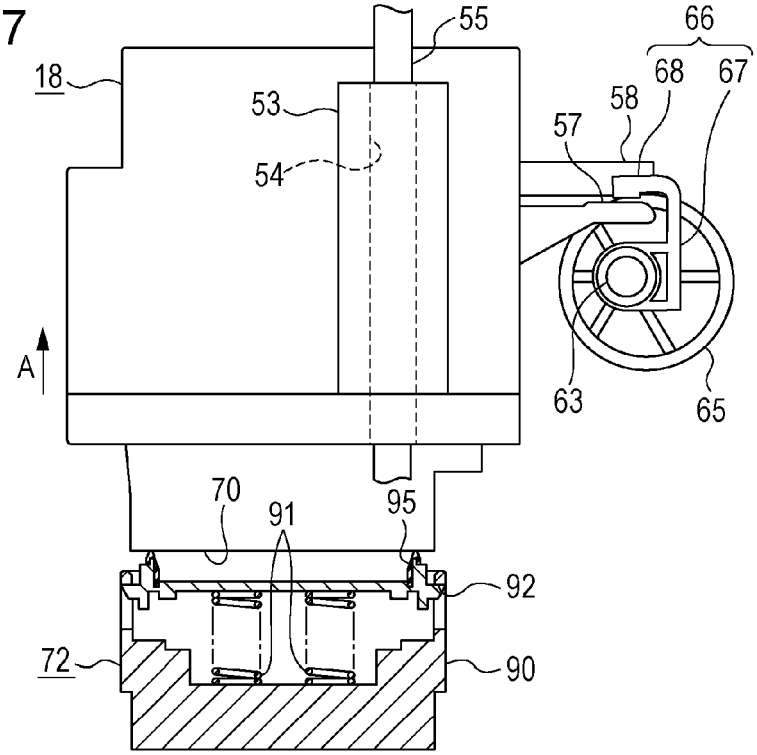
FIG. 7 is a schematic diagram showing the cap in the course of moving to a tightly closing position and also showing the liquid ejecting unit.

As shown in FIG. 7, when the adjustment motor 61 is driven in the forward rotation direction, the pivot shaft 63, the cams 65 and the engaging portions 66 pivot in the forward direction (the counterclockwise direction in FIG. 7) from the state shown in FIG. 5 or FIG. 6. Then, the engaging portions 66 pivot to a position at which the engaging portions 66 and the engaged portions 57 overlap in the movement direction A.

Incidentally, as stated above, the inside diameter of the hook portions 68 is equal to the outside diameter of cams 65, and the engaged portions 57 are positioned closer to the pivot shaft 63 than the follower portions 58 are. Therefore, as the engaging portions 66 pivot to such a position that the engaged portions 57 are positioned between the hook portions 68 and the pivot shaft 63, the cams 65 pivoting together with the engaging portions 66 slightly pushes the liquid ejecting unit 18 upward from the first position F. Furthermore, at this time, there is a gap between each engaging portion 66 and the corresponding one of the engaging portions 57. Still further, the liquid ejecting unit 18 is positioned at a position that is different from the second position G. After that, the movement motor 75 is driven in the reverse rotation direction.

Then, as shown in FIG. 7, during the movement of the cap 72 from the non-tightly closing position D to the tightly closing position B, the cap frame 95 comes into contact with the nozzle formation surface 70.

Figure 8:
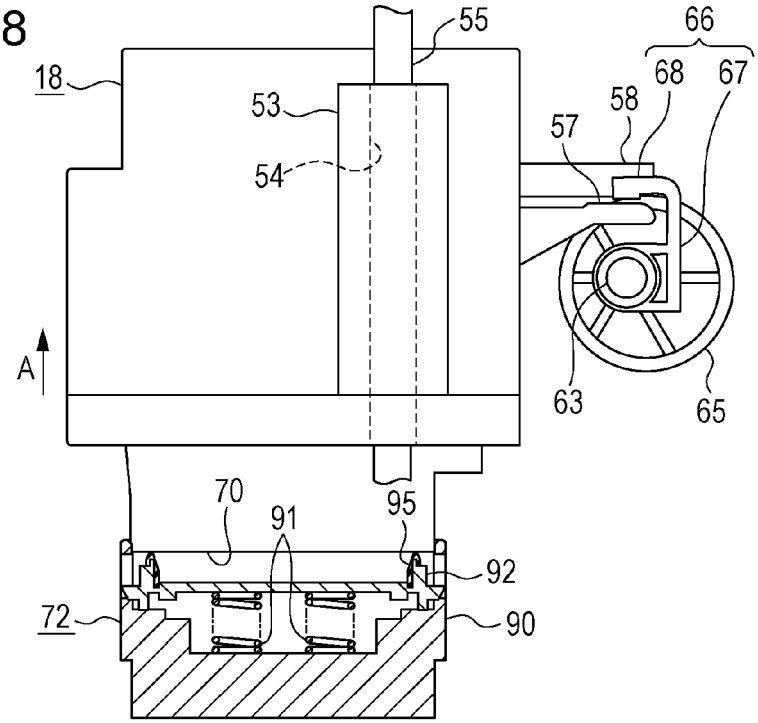
FIG. 8 is a schematic diagram showing the cap positioned at the tightly closing position and the liquid ejecting unit.

After that, when the cap 72 moves to the tightly closing position B as shown in FIG. 8, the liquid ejecting unit 18 is urged by the springs 91. Therefore, the liquid ejecting unit 18 tends to be moved away from the transport path 13 in the movement direction Awhile being guided by the guide members 55.

However, the engaging portions 66 engage with the engaged portions 57 from a direction that is different from the movement direction A (from the direction opposite to the movement direction A in this embodiment). Therefore, when the engaging portions 66 and the engaged portions 57 engage with each other, further movement of the liquid ejecting unit 18 is restricted. In the course of the movement from the non-tightly closing position D to the tightly closing position B, the cap 72 at least contacts the liquid ejecting unit 18 and then moves in the same movement direction A as the liquid ejecting unit 18 to reach the tightly closing position B, thereby pressing the liquid ejecting unit 18 and simultaneously tightly closing the space that the nozzles 71 face. At the time point when the cap 72 begins to contact the liquid ejecting unit 18, there is a gap between the engaging portions 66 and the engaged portions 57. Therefore, the impact at the time of the contact can be relieved using the gap, and the cap 72 can be smoothly moved to the tightly closing position B while pressing the liquid ejecting unit 18. Thus, it is possible to carry out the capping while restraining faults such as destruction of the menisci.

According to the foregoing embodiment, the following advantageous effects can be obtained.

(1) The engaging portions 66 that pivot together with the pivot shaft 63 engage with the engaged portions 57 provided on the liquid ejecting unit 18, from a direction that is different from the movement direction of the cap 72. Therefore, when the cap 72 is brought into contact with the liquid ejecting unit 18, the engagement between the engaged portions 57 and the engaging portions 66 restricts the movement of the liquid ejecting unit 18 caused by the cap 72 contacting and pressing the liquid ejecting unit 18. Therefore, the cap 72 can be caused to contact, with a sufficient pressure, the liquid ejecting unit 18 provided so as to be adjustable in position.

(2) The engaging portions 66 engage with the engaged portions 57 of the liquid ejecting unit 18 from a direction substantially opposite to the direction in which the cap 72 presses the liquid ejecting unit 18. Therefore, the movement of the liquid ejecting unit 18 caused by the cap 72 contacting and pressing the liquid ejecting unit 18 can be efficiently restricted.

(3) When the engaging portions 66 that pivot together with the pivot shaft 63 engage with the engaged portions 57, each engaging portion 66 and the pivot shaft 63 are substantially aligned in the movement direction A of the cap 72. Therefore, even in the case where the cap 72 moves along the movement direction A and contacts and presses the liquid ejecting unit 18, the risk that the engaging portions 66 pressed by the engaged portions 57 of the liquid ejecting unit 18 may pivot can be reduced.

(4) The liquid ejecting unit 18 is adjusted in position between the first position F and the second position G. Then, the engaging portions 66 engage with the engaged portions 57 of the liquid ejecting unit 18 when the liquid ejecting unit 18 is at a position different from the second position G. Therefore, the moving distance of the cap 72 can be made shorter than in the case where the cap 72 is brought into contact with the liquid ejecting unit 18 while the engaged portions 57 and the engaging portions 66 are engaged when the liquid ejecting unit 18 is positioned at the second position G higher than the first position F.

(5) Since the engaged portions 57 are protruded from the liquid ejecting unit 18, the degree of freedom in disposing the liquid ejecting unit 18 and the pivot shaft 63 can be increased.

(6) Since the liquid ejecting unit 18 urged by the cap 72 is restricted from moving by the engaging portions 66, the clattering of the liquid ejecting unit 18 can be restrained, for example, when the printer 11 is transported.

Incidentally, the foregoing embodiment may be modified as follows.

In the foregoing embodiment, the cap 72 may have a construction that does not include a spring 91. For example, springs may be provided between the cap and the first outer link member 81*a* and between the cap and the first inner link member 81*b* so that the cap has been urged by the springs when caused to contact the liquid ejecting unit 18.

In the foregoing embodiment, it is permissible to configure the adjustment mechanism 60 so that the pivot shaft 63 is manually pivoted, instead of providing the adjustment motor 61 and the transfer mechanism 62. Furthermore, the moving mechanism 73 may also be configured so that the screw shaft 76 is manually rotated, instead of being provided with the movement motor 75.

In the foregoing embodiment, the engaging portions 66 may have a construction in which at least one surface of the inner side surfaces and the outer side surfaces of the proximal end portion 67 and the hook portion 68 and the side surfaces of the pivot shaft 63 in its axis direction is provided with a reinforcement member such as a metal plate.

In the foregoing embodiment, to carry out the capping, the pivot shaft 63 may be pivoted until the engaging portions 66 engage with the engaged portions 57, and then the cap 72 may be moved to the tightly closing position B.

In the foregoing embodiment, the inside diameter of the engaging portions 66 do not necessarily need to be equal to the outside diameter of the cam 65. For example, it is permissible to adopt a construction in which an engaged portion 57 and a follower portion 58 are formed at the same position in the movement direction A and the inside diameter of the engaging portion 66 is equal to the outside diameter of a cam 65.

In the foregoing embodiment, the engaged portions 57 do not need to be protruded from the surface of the liquid ejecting unit 18; for example, engaged portions 57 may be formed to have a stepped shape, a groove shape, a bore shape or a hole shape. Furthermore, the engaged portions 57 may be replaced by an upper surface of the liquid ejecting unit 18 so that engaging portions 66 engage with the upper surface. Still further, a hook portion 68 may be provided at an outer side of the cam 65 in the diameter direction of the cam 65, and the engaging portions 66 may be engaged with the follower portion 58.

In the foregoing embodiment, the pivot shaft 63 may be provided at a position that is farther from the transport path 13 than the engaged portions 57 are from the transport path 13. That is, engaged portions 57 may be provided so as to be between a pivot shaft 63 and a transport path 13 in the movement direction. Incidentally, in this case, a cam 65 and the liquid ejecting unit 18 may be interconnected so that the cam 65 is pivoted together with the pivot shaft 63 to move the liquid ejecting unit 18 upward.

In the foregoing embodiment, the phases of the engaging portions 66 and the cams 65 may be changed arbitrarily. For example, an engaging portion 66 may be provided so as to be in phase with the smallest diameter of a cam 65. Specifically, the capping may be carried out when the liquid ejecting unit 18 is positioned at the first position F. Furthermore, an engaging portion 66 may be provided so as to be in phase with the largest diameter of a cam. Specifically, the capping may be carried out when the liquid ejecting unit 18 is positioned at the second position G. Incidentally, when the cap 72 is brought into contact with the liquid ejecting unit 18 when the liquid ejecting unit 18 is at the second position G, it is preferable to reduce the impact of the cap 72 on the liquid ejecting unit 18 by moving the cap 72 at a slower speed than in the case where a gap is provided between the engaging portions 66 and the engaged portions 57.

In the foregoing embodiment, the adjustment mechanism 60 may adjust the position of the liquid ejecting unit 18 in a part of the range in which the liquid ejecting unit 18 is movable. Specifically, the first position F and the second position G are set within a range in which the liquid ejecting unit 18 is movable, and the adjustment mechanism 60 may adjust the position of the liquid ejecting unit 18 between the first position F and the second position G.

In the foregoing embodiment, the engaged portions 57 may not be aligned with the pivot shaft 63 in the movement direction A.

In the foregoing embodiment, the direction in which the engaging portions 66 engage with the engaged portions 57 may be arbitrarily changed as long as the direction is different from the movement direction A.

In the foregoing embodiment, the engaging portions 66 may, for example, frictionally engage by coming into pressing contact with a side surface of the liquid ejecting unit 18. In this case, the side surface of the liquid ejecting unit 18 functions as an engaged portion.

In the foregoing embodiment, the liquid ejecting unit 18 may be a so-called carriage type unit that ejects a liquid to a medium by moving back and forth instead of the so-called line head capable of ejecting an ink simultaneously throughout the entire width whose direction intersects the transport direction.

In the foregoing embodiment, the liquid ejecting apparatus may be a liquid ejecting apparatus that ejects or discharges a liquid other than ink. Incidentally, the state of the liquid discharged in the form of droplets of a very small quantity from the liquid ejecting apparatus includes a particulate shape, a teardrop shape, and a shape with a thready tail. Furthermore, it suffices that the liquid mentioned herein is a material that can be ejected from a liquid ejecting apparatus. For example, it suffices that the liquid is a state of matter in which the matter is in a liquid phase, and the liquid includes liquid bodies with high or low viscosity and fluid bodies such as sols and gel waters as well as other inorganic solvents, organic solvents, solutions, liquid resins, and liquid metals (metal melts). Furthermore, the liquid herein includes not only a liquid as a state of matter but also solutions, dispersions and mixtures of particles of functional materials made of solids of pigments, metal particles, etc. in solvents. Representative examples of the liquid include ink as described above in conjunction with the embodiment, liquid crystals, etc. The ink herein includes standard aqueous inks and oil-based inks and also includes various liquid compositions such as gel inks and hot melt inks. Concrete examples of the liquid ejecting apparatus include liquid ejecting apparatuses that eject a liquid that contains in the form of a dispersion or solution a material such as an electrode material or a color material that is used in, for example, the production of liquid crystal displays, EL (electroluminescence) displays, surface-emitting displays, or color filters. Furthermore, the liquid ejecting apparatus may also be a liquid ejecting apparatus that ejects a bioorganic substance for use in the production of a biochip, a liquid ejecting apparatus that is used as a precision pipette to eject a sample liquid, a textile printing apparatus, a microdispenser, etc. Still further, the liquid ejecting apparatus may also be a liquid ejecting apparatus that ejects a lubricating oil in a pinpoint manner to a precision machine, such as a clock or a camera, or a liquid ejecting apparatus that ejects a transparent resin liquid, such as an ultraviolet curable resin, onto a substrate in order to form a micro-hemispherical lens (optical lens) or the like for use in an optical communication element or the like. Further, the liquid ejecting apparatus may also be a liquid ejecting apparatus that ejects an etching liquid, such as an acid or alkali liquid, in order to etch a substrate or the like.

The entire disclosure of Japanese Patent Application No. 2014-182013, filed Sep. 8, 2015 is expressly incorporated by reference herein.

What is claimed is:

1. A liquid ejecting apparatus comprising:

a liquid ejecting unit that ejects a liquid from a nozzle to a medium transported by a transport section;

an adjustment mechanism that adjusts a height position of the liquid ejecting unit by moving the liquid ejecting unit;

a cap capable of tightly closing a space that the nozzle faces; and a moving mechanism that moves the cap between a tightly closing position at which the cap tightly closes the space that the nozzle faces and a non-tightly closing position that is different from the tightly closing position, wherein:

the adjustment mechanism includes a pivot shaft provided along a width direction that intersects a transport direction in which the medium is transported by the transport section, a plurality of cams that are spaced from each other in the width direction and move the liquid ejecting unit by pivoting together with the pivot shaft and contacting the liquid ejecting unit, and an engaging portion capable of pivoting together with the pivot shaft and engaging with an engaged portion that is provided on the liquid ejecting apparatus; and the engaging portion engages with the engaged portion from a direction different from a movement direction in which the cap moves from the non-tightly closing position to the tightly closing position, wherein the engaging portion engages with the engaged portion from the direction opposite to the movement direction, wherein the engaged portion and the pivot shaft are substantially aligned in the movement direction, wherein the adjustment mechanism adjusts the height position of the liquid ejecting unit between a first position and a second position that is higher than the first position; and the engaging portion engages with the engaged portion of the liquid ejecting unit when the liquid ejecting unit is at a position different from the second position.

2. The liquid ejecting apparatus according to claim 1, wherein:

the engaged portion of the liquid ejecting unit at the position different from the second position and the engaging portion are spaced from each other by a gap when the cap comes into contact with the liquid ejecting unit; and the cap comes into contact with the liquid ejecting unit and then presses the liquid ejecting unit in such a direction as to eliminate the gap.

3. The liquid ejecting apparatus according to claim 1, wherein the engaged portion is protruded from the liquid ejecting unit.

4. A liquid ejecting apparatus comprising:

a liquid ejecting unit that ejects a liquid from a nozzle to a medium transported by a transport section;

an adjustment mechanism that adjusts a height position of the liquid ejecting unit by moving the liquid ejecting unit;

a cap capable of tightly closing a space that the nozzle faces;

a moving mechanism that moves the cap between a tightly closing position at which the cap tightly closes the space that the nozzle faces and a non-tightly closing position that is different from the tightly closing position;

an engaged portion that is provided on the liquid ejecting unit; and an engaging member that moves between an opposing position which is faced to a moving direction of the engaged portion and a retracting position which retracts from the opposing position, by using power of the adjustment mechanism, wherein when a capping operation starts by the cap, the engaging portion moves to the opposing position, thereafter the cap moves from the non-tightly closing position to the tightly closing position, and the cap is regulated by contact between the engaged portion of the liquid ejecting unit and the engaging member, and is positioned at the tightly closing position.

5. The liquid ejecting apparatus according to claim 4, wherein the adjustment mechanism has a pivot shaft, a cam which is provided with the pivot shaft and a cam follower which displaces the height position of the liquid ejecting unit following the cam, wherein the engaging member is driven by the pivot shaft.

6. The liquid ejecting apparatus according to claim 4, wherein the liquid ejecting unit is constituted of a line head.

* * * * *